United States Patent [19]

Tenney

[11] 4,391,568

[45] Jul. 5, 1983

[54] GAS COMPRESSOR

[76] Inventor: William L. Tenney, Crystal Bay, Minn. 55323

[21] Appl. No.: 238,011

[22] Filed: Feb. 25, 1981

Related U.S. Application Data

[63] Continuation of Ser. No. 917,185, Jun. 6, 1978, abandoned.

[51] Int. Cl.[3] ..... F04B 41/04; F04B 17/00

[52] U.S. Cl. ..... 417/237; 417/238; 417/364; 123/DIG. 7; 165/125

[58] Field of Search ..... 417/237, 238, 243, 364; 92/144; 123/DIG. 7; 165/125

[56] References Cited

U.S. PATENT DOCUMENTS

| | | | |
|---|---|---|---|
| 1,584,787 | 5/1926 | Marshall . | |
| 1,694,218 | 12/1928 | Hazard . | |
| 1,700,372 | 1/1929 | Leinert . | |
| 1,800,631 | 4/1931 | Hewitt et al. . | |
| 1,893,650 | 1/1933 | Modine | 165/125 |
| 1,993,230 | 3/1935 | Taylor | 230/50 |
| 2,150,912 | 3/1939 | Clapp | 230/182 |
| 2,161,828 | 6/1939 | Lamberton | 230/30 |
| 2,256,654 | 9/1941 | Spurgeon et al. | 230/58 |
| 2,267,479 | 12/1941 | Sturm et al. | 230/228 |
| 2,454,654 | 11/1948 | Kaufman | 165/125 X |
| 2,482,626 | 9/1949 | Lamberton | 230/211 |
| 2,522,649 | 9/1950 | Tenney | 123/70 |
| 2,622,791 | 12/1952 | Wescombe | 230/182 |
| 2,902,205 | 9/1959 | Parker | 230/38 |
| 2,956,620 | 10/1960 | Turnwald | 230/231 |
| 3,066,856 | 12/1962 | Frank | 230/231 |
| 3,292,848 | 12/1966 | Kehler | 230/231 |
| 3,986,798 | 10/1976 | Lindell et al. | 417/564 |

FOREIGN PATENT DOCUMENTS

| | | | |
|---|---|---|---|
| 1063322 | 8/1959 | Fed. Rep. of Germany | 417/243 |
| 1382117 | 11/1964 | France | 417/243 |
| 456502 | 11/1936 | United Kingdom | 417/243 |

OTHER PUBLICATIONS

*Drawing No.* 812285.
*Sears Catalog*, p. 79.
*Champion–Portable Air Compressors* brochure, 4 pages.
*Champion–Air Compressors* brochure –Single Stage, p. 7.
*Champion–Air Compressors* brochure–Gasoline Powered, pp. 15 & 16.
*Champion –Air Compressors* brouchure –Air Cooled Aftercooler.
*Atlas Copco* L–Compressor Series brochure.
*Grimmer Schmidt Air Machine* –Bul. 150E75.
*Iowa Mold Tooling Company, Inc.* catalog, pp. 20 & 21.
*Iowa Mold Tooling Co.* catalog, V.W. Turbo 55, p. 1.
*Kohler 4–Cycle Engines* brochure.

*Primary Examiner*—Richard E. Gluck
*Attorney, Agent, or Firm*—Burd, Bartz & Gutenkauf

[57] ABSTRACT

A gas compressor drivably connected to an engine operates to supply compressed gas to a tank. The compressor has a housing including a commercial air cooled internal combustion engine block and cooling air system having a single cylinder chamber accommodating a reciprocating piston. The piston moves gas through a head and valve assembly connected to an air-to-air after cooler operable to cool and carry cooled compressed gas to a tank. The head holds the valve assembly on the cylinder. The valve assembly has a first valving ring allowing one-way flow of gas into the cylinder chamber and a second valving ring allowing one-way gas flow out of the cylinder chamber. A heat exchange unit is cooled with air moved by the commercial engine air cooling system of the compressor. The driving engine is of the same make and general type as used for the components of the compressor.

13 Claims, 12 Drawing Figures

FIG. 3
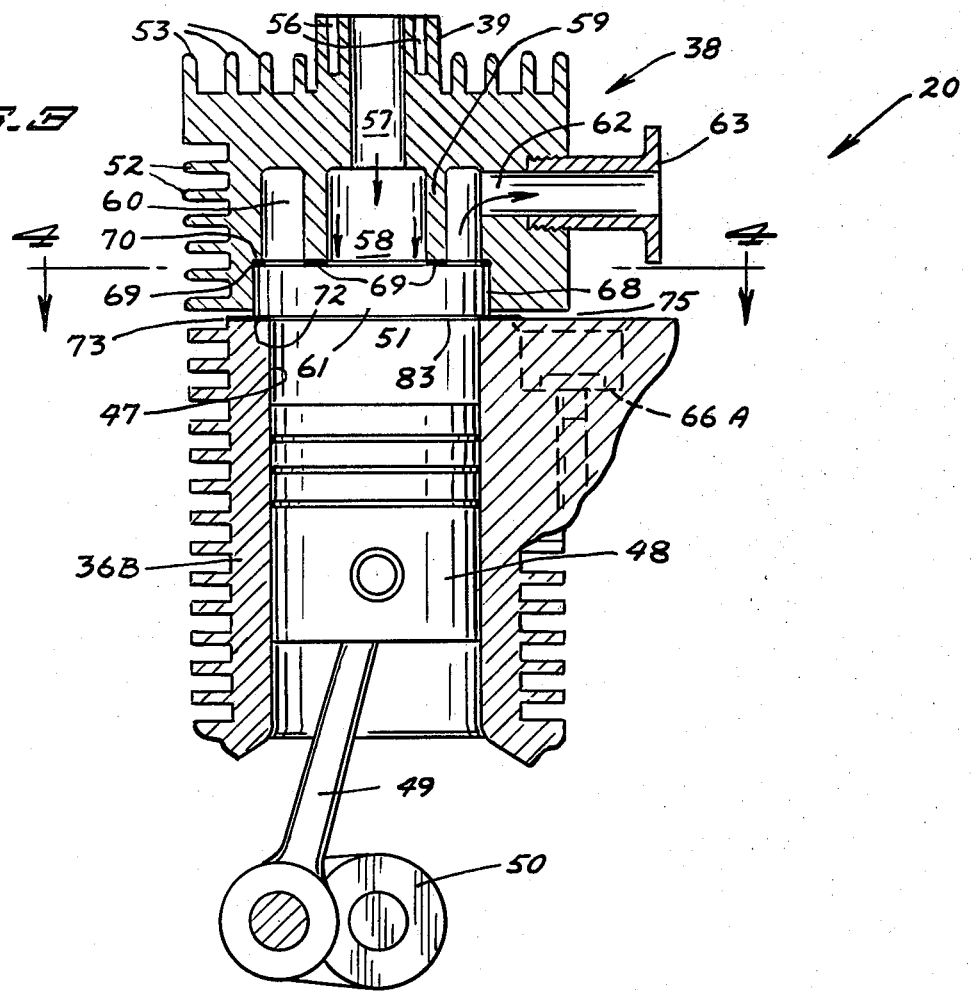
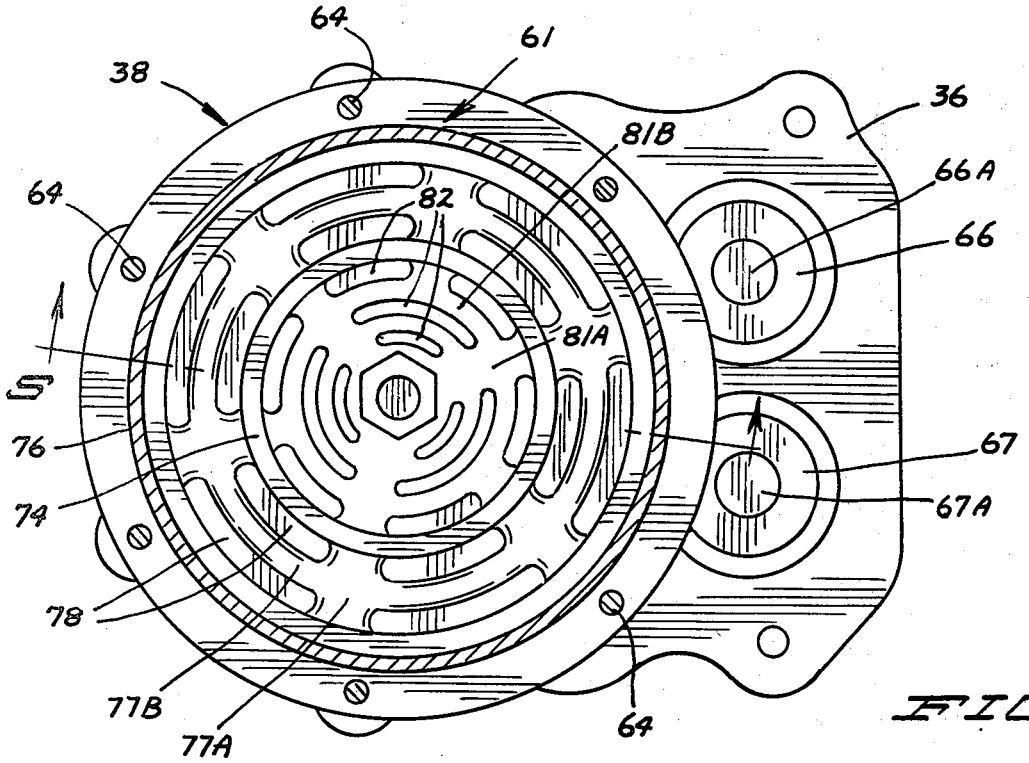
FIG. 4

GAS COMPRESSOR

This Application is a Continuation of U.S. Application Ser. No. 917,185, filed June 6, 1978, now abandoned.

BACKGROUND OF INVENTION

Piston type air compressors are used to supply air under pressure for many purposes. Electric motors and internal combustion (I.C.) engines may drive the compressors. The air compressors have housings and cylinders formed with chambers for accommodating reciprocating pistons. The housings and cylinders are individually designed for use with heads and inlet and outlet structures for controlling the flow of air. Fins on the cylinders and heads are provided to dissipate heat to the surrounding air.

SUMMARY OF INVENTION

The invention is directed to an apparatus for compressing gas, as air. More particularly, the invention may be a single stage air compressor powered with an I.C. engine, electric motor, or other power source. The air compressor includes a housing and a cylinder defining a chamber or bore and a rotatable crankshaft. A piston connected to the crankshaft is movably located in the chamber. The cylinder with its chamber accommodating a high production I.C. engine piston and crankshaft assembly is a conventional single cylinder, four-cycle, air cooled commercial I.C. engine block that is similar in make and design to the driving I.C. engine when I.C. engine power is used. The commercial engine block and its air cooling system is a sturdy, low-cost, efficient unit made by mass production processes. A suitable valve assembly mounted on the cylinder with a head controls the flow of air into and out of the cylinder chamber in response to movement of the piston. The valve assembly shown and described hereinafter has inlet and outlet valving means biased in opposite directions to normally closed positions. The valve assembly is located in the head which is positioned over the top of the cylinder. The head has inlet and outlet passages in communication with the inlet and outlet valving means to allow air to flow to and from the valve assembly.

The compressed air can flow if desired from the head through an air-to-air after cooler connected to an air use device which may be an air storage tank. The after cooler is an air-to-air heat exchanger. The product on engine cooling air blower drivably connected to the crankshaft operates to move air past the heat exchanger to carry heat away from the after cooler, thereby cooling the air moving through the after cooler. The blower also moves the air past the head which has cooling fins so that the air cools the head and compressed air inside the head. The air also cools the finned cylinder in the usual manner.

An object of the invention is to provide a gas compressor that has a large cfm volume output at a low cost per horsepower input. A further object of the invention is to provide a low-cost, compact and rugged air compressor, which utilizes a block, cylinder, piston, crankshaft and air cooling structure of a conventional single cylinder, high production, commercial, four-cycle air cooled I.C. engine. A further object of the invention is to provide an air compressor with an integral air-to-air after cooler to cool the temperature of the delivered compressed air when desired. Yet another object of the invention is to provide an air compressor that utilizes a conventional block, cylinder, piston and crankshaft and air cooling system of an I.C. engine drivably connected to an I.C. engine, preferably of the same make and general type, whereby both the engine and the compressor can be easily serviced by one skilled in the servicing and repair of the particular engine, and whereby the principal running parts of both the engine and compressor, except for the head and valve mechanisms, are similar and largely interchangeable. These and other objects and advantages of the invention are embodied in the following described embodiments of the air compressor.

IN THE DRAWINGS

FIG. 3 is a fragmentary vertical sectional view of the gas compressor of FIG. 1;

FIG. 4 is an enlarged sectional view taken along the line 4—4 of FIG. 3;

DESCRIPTION OF PREFERRED EMBODIMENTS

Figure 1:
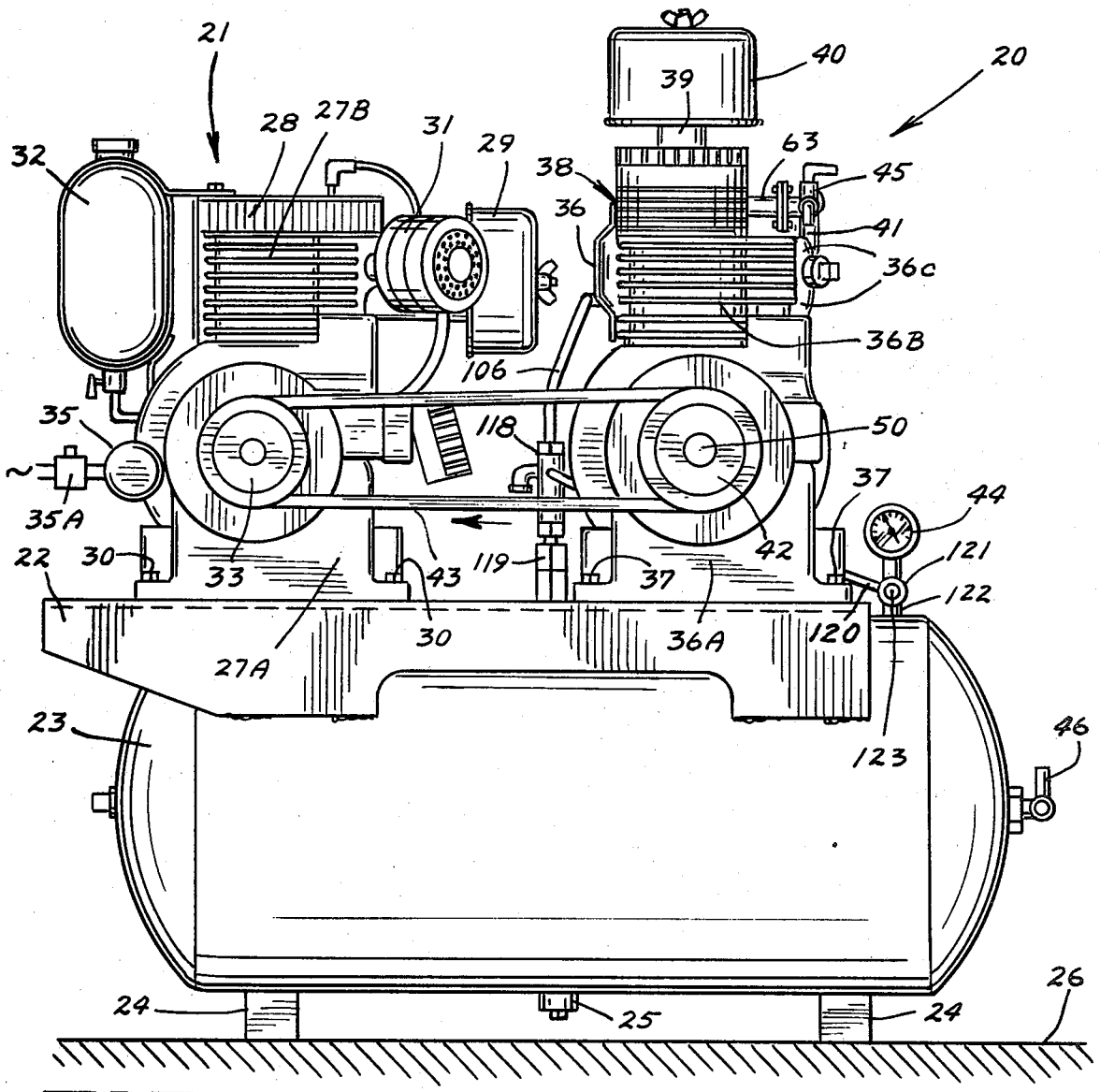
FIG. 1 is a side elevational view of one modification of the gas compressor of the invention.
Figure 2:
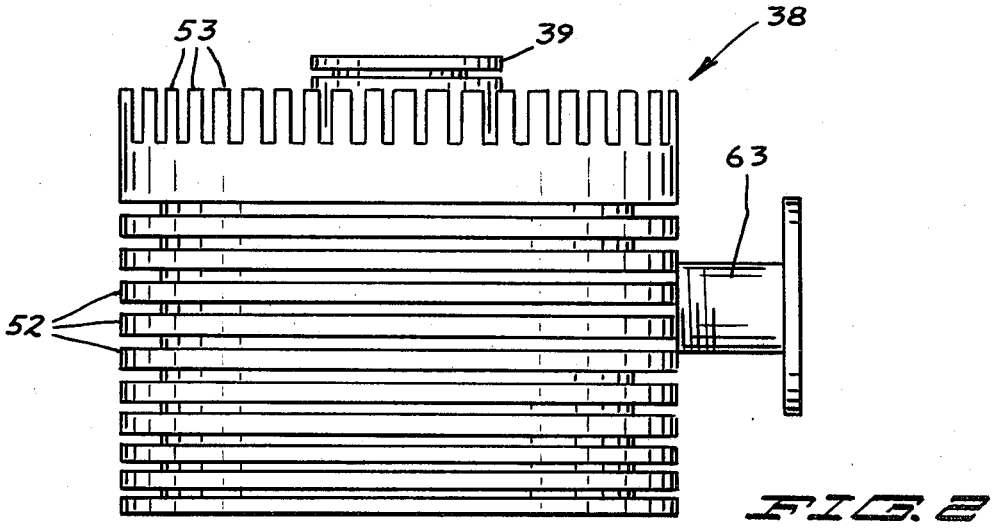
FIG. 2 is a side elevational view of the head of the gas compressor of FIG. 1.

Referring to FIG. 1, there is shown a gas compressor indicated generally at 20. The gas is hereinafter identified as air; however, other types of gases can be compressed with compressor 20. Compressor 20 is operated by a power unit shown as an internal combustion (I.C.) engine 21 mounted on a table 22. Table 22 is an inverted channel member secured to a cylindrical tank or air receiver 23. Table 22 forms a horizontal platform over the top of tank 23. Tank 23 rests on a pair of legs or supports 24. Legs 24 engage a supporting surface 26. Fasteners (not shown) can be used to attach the legs 24 to support 26. A drain plug 25 is attached to the bottom of tank 23.

Engine 21 is preferably an internal combustion (I.C.) engine having a housing or crankcase 27A secured with bolts 30 to platform 22. A head 28 is mounted on top of a cylinder 27B extended upwardly from crankcase 27A. Air intake means including an air cleaner 29 is provided. The air intake means is attached to a conventional carburetor for supplying an air fuel mixture to the engine. An exhaust port is also provided for carrying a muffler 31. A fuel tank 32 is mounted on the side of the engine.

However, a fuel supply may be located elsewhere, as desired. An electric starter 35 mounted on crankcase 27A is used to turn the engine to start the combustion process. A starter switch 35A and electric cables connect starter 35 to an electric power source, as a battery. Engine 21 may be provided with a hand crank or recoil starting mechanism in lieu of the electric starter. Engine 21 has an output or drive pulley 33 that is drivably connected with air compressor 20. Engine 21 can be a conventional I.C. engine. For example, engine 21 can be a Kohler 16 h.p. gasoline I.C. engine having an electric starter and a governed speed of 3200 rpm. Other types of engines, such as electric or diesel type, can be used to drive air compressor 20.

Air compressor 20 has a housing or crankcase 36A mounted on table 22 with a plurality of bolts 37. An upright cylinder 36B is mounted on top of crankcase 36A. Crankcase 36A and cylinder 36B can be a one piece engine block casting of metal, as cast iron, aluminum, or the like.

Crankcase 36A, cylinder 36B, piston 48 and crankshaft assembly and air cooling system of compressor 20 are all standard components of a commercial, air cooled, single cylinder, four cycle I.C. engine; for example, a Kohler 16 h.p. gasoline I.C. engine made by Kohler Company, of Kohler, Wisconsin.

Cylinder 36B has a plurality of outwardly directed heat dissipating fins 36C. A head indicated generally at 38 is mounted to the top of cylinder 36B. A short upright air intake hub 39 is integral with the top of head 38. The top of hub 39 carries an inverted cup-shaped cover 40 for accommodating suitable air filtering structure which may be similar to the air filter 29. Head 38 is connected to an outlet line 41 that carries compressed hot air to an air cooling unit or after cooler 101, shown in FIG. 7. A tubular line 106 carries the air from cooler 101 to a manifold unloader valve 118 connected to a check valve 119 mounted on tank 23. When the air pressure in tank 23 is below a predetermined level, the compressed air will discharge into tank 23. As soon as the air pressure in tank 23 reaches the desired pressure, unloader valve 118 is actuated to direct the air to the atmosphere. A pilot valve 121 in communication with the air pressure in tank 23 actuates unloader valve 118. A tubular line 120 connects pilot valve 121 to unloader valve 118. An air pressure gauge 44 and safety pressure release valve 123 are mounted on connector 122 used to couple pilot valve 121 with tank 23.

Compressor 20 has a drive pulley 42 coupled to engine pulley 33 with one or more belts 43, such as V-belts. Pulleys 33 and 42 can also be sprockets that are drivably connected with a link chain, as a roller chain. A suitable safety shield or guard (not shown) mounted on crankcase 27A and 36A covers pulleys 33 and 42 and belts 43. On operation of engine 21, air compressor 20 operates to supply air under pressure to tank 23. The pressure of the air in tank 23 is monitored with a gauge 44. A manual outlet valve 46 mounted on one end of the tank 23 is used to control the flow of compressed air through a coupling that is used to attach a line or suitable hose that carries the air to a desired tool or location.

A starting manual unloader valve 45 is located in outlet line 41. Valve 45 is operable to vent line 41 to atmosphere to facilitate starting of compressor 20.

Referring to FIG. 3, air compressor cylinder 36B is a commercial I.C. engine cylinder having a cylindrical bore 47 accommodating the standard I.C. engine piston 48. Piston 48 is pivotally connected to a connecting rod 49. Connecting rod 49 is journaled to the usual crankshaft 50. Pulley 42 is connected to one end of the crankshaft 50 so that motor 21 can rotate crankshaft 50 and thereby reciprocate piston 48 in bore 47.

Head 38 is located adjacent the top of cylinder 36B at the upper end of chamber 51. Head 38 has a plurality of circumferential outwardly directed cooling fins 52 and a plurality of upwardly directed cooling fins 53. Head 38 is an aluminum one piece member. Other metals and materials can be used to make head 38. The central portion of the top of head 38 has an upwardly directed hub 39 having threaded bores 56 for receiving bolts used to attach an air filtering unit 40 to head 38. Hub 39 has a central inlet passage 57 leading to a central inlet chamber 58. A valve assembly 61 in communication with the chamber 58 functions to allow air to flow from chamber 58 into compression chamber 51 in response to the down or intake stroke of piston 48. An annular wall 59 separates the central inlet chamber 58 from an annular outlet chamber 60. Head 38 has a lateral outlet passage 62 open to chamber 60. A flanged nipple 63 threadably coupled to head body 38 provides an extension of outlet passage 62. Nipple 63 is part of gas outlet line 41.

As shown in FIG. 4, a plurality of bolts 64 secure head 38 to the top of cylinder 36B over compression chamber 51. Bolts 64 are spaced about valve assembly 61 to clamp valve assembly 61 on cylinder 36B over chamber 51. Bolts 64 are threaded into the same tapped holes in cylinder 36B provided for the commercial I.C. engine head bolts. The conventional intake port 66 and exhaust port 67 of the cylinder 36B are open to the atmosphere and not in communication with chamber 51. Plugs 66A and 67A fit into the upper end of the valve guide bores to prevent foreign material from falling into the crankcase. Cylinder 36B, piston 48, connecting rod 49, and crankshaft 50 are parts of a conventional single cylinder, air cooled, four cycle, commercial I.C. engine.

As shown in FIG. 3, valve assembly 61 is a cylindrical unit that fits into a recess 68 in the bottom of head 38. The top of valve assembly 61 engages a flat gasket 69 which seals on a shoulder 70 and also on the bottom of an annular wall or sleeve 59. A second flat annular gasket 73 is located on the top or deck 72 of cylinder 36B and engages the bottom of valve assembly 61. Gasket 73 functions as an annular seal located on the flat top deck of cylinder 36B surrounding the upper end of chamber 51. The bottom of head 38 is spaced a short distance 75 above top deck 72 on the cylinder 36B. This insures that head 38 under pressure from bolts 64 applies clamping forces on valve assembly 61. The gaskets 69 and 73 are clamped into tight sealing engagement with the opposite sides of valve assembly 61 to insure the sealing of the valve assembly with both head 38 and cylinder 36B.

Figure 5:
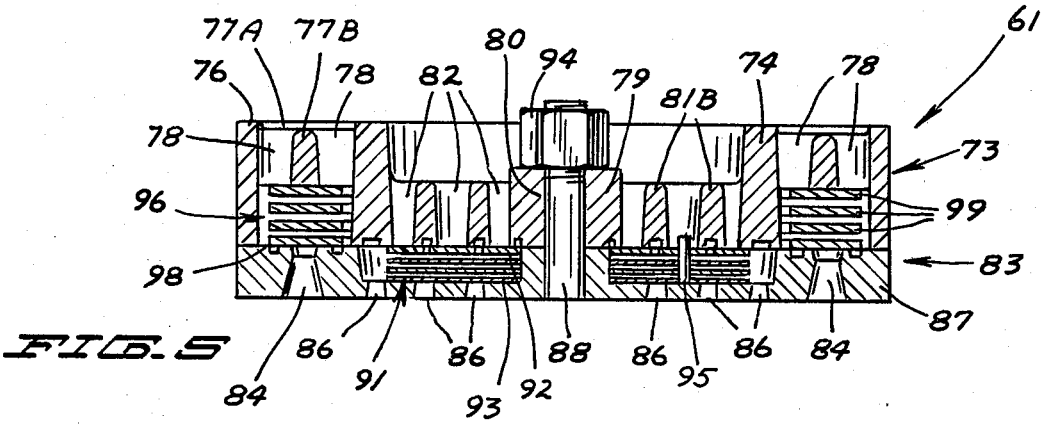
FIG. 5 is a sectional view taken along the line 5—5 of FIG. 4.
Figure 6:
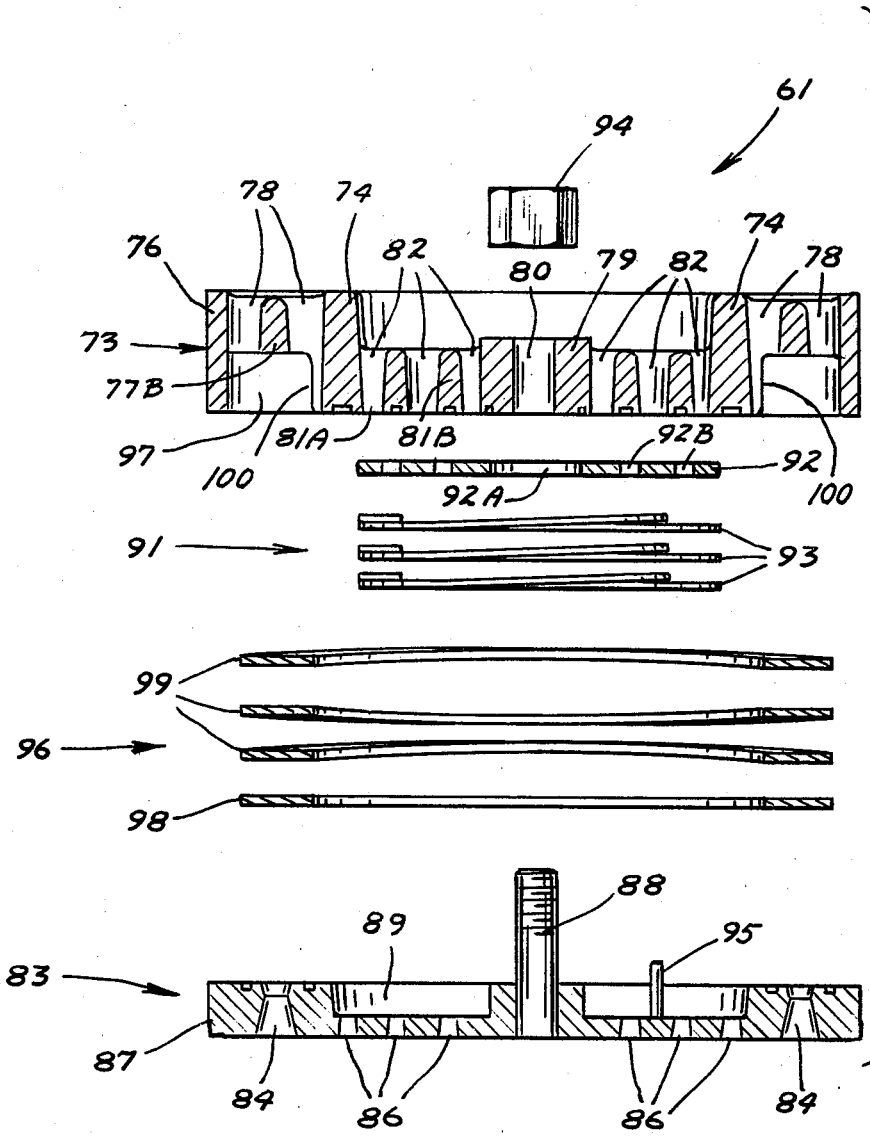
FIG. 6 is an exploded sectional view of the valve unit of FIG. 5.

Referring to FIGS. 5 and 6, there is shown a detailed structure of valve assembly 61. Valve assembly 61 has a first cylindrical body 73 comprising an inner annular sleeve or wall 74 surrounded by an outer annular sleeve or wall 76. Radially directed ribs 77A connected with short arcuate segments 77B secure the inner sleeve 74 to outer sleeve 76. The ribs 77A and segments 77B are spaced from each other to provide a plurality of outlet passages 78. As shown in FIG. 4, outlet passages 78 are arcuate elongated slots located between the sleeves 74 and 76 and extend arcuately around sleeve 74. The center part of body 73 has a cylindrical hub 79 containing a central hole 80.

Returning to FIG. 4, a plurality of radially directed ribs 81A and circumferential segments 81B connect adjacent ribs to secure hub 79 to inner sleeve 74. Ribs 81A and segments 81B are spaced from each other to provide a plurality of arcuate slots or inlet passages 82.

Returning to FIGS. 5 and 6, valve assembly 61 has a second body 83. Body 83 is a generally circular disc member having a plurality of outlet holes or passages 84 and a plurality of inlet holes or passages 86. An upwardly directed bolt 88 is secured by threads (not shown) or the like to the center of body 83. An annular recess 89 is provided in the upper part of body 83 adjacent inlet holes 86. Recess 89 is aligned with inlet openings 82.

An inlet valve structure indicated generally at 91 is located in the recess 89 when body 83 is attached to body 73. Bolt 88 extends through hole 80. A nut 94 is threaded onto bolt 88 to secure bodies 83 and 73 together. Inlet valve 91 comprises a flat valving member or ring 92 having a central opening 92A and intermediate openings 92B. Openings 92B allow air to flow through plate 92 when the plate is in the open position. The air also flows around the outer edge of plate 92 when it is in the open position. A plurality of finger leaf springs 93 are interposed between valving ring 92 and body 83 to bias ring 92 into engagement with the bottom side of body 73 thereby closing the inlet passages 82. Springs 93 have spaced fingers that are aligned with the solid parts of ring 92. The air flows through the spaces between the fingers as it moves through the valve assembly 61 into chamber 51. An upright locating pin 95, shown in FIG. 5, projects through suitable holes in ring 92 and openings in springs 93 to maintain springs 93 and ring 92 in proper relationship. Vacuum or negative pressure in chamber 51 will move ring 92 downwardly against the biasing force of springs 93 and thereby allow air to flow through passages 82 past ring 92, springs 93, and through passages 86 into pump chamber 51. A positive pressure in chamber 51 will move ring 92 upwardly to the closed position. When ring 92 is in the closed position, it blocks the passages 82. Springs 93 hold the ring 92 in its closed position.

An outlet valve indicated generally at 96 is located in an annular chamber 97 between inner sleeve 74 and outer sleeve 76 of body 73. Outlet valve 96 has a flat valving member or ring 98 adapted to fit over outlet openings 84 in second body 83. A plurality of springs or wave washers 99 are interposed between valve ring 98 and body 73 to bias valve ring 98 downwardly into engagement with second body 83 in the closed position. Sleeve 74 has a plurality of outwardly directed abutments 100 which center and guide valve ring 98 and wave washers 99. When piston 48 moves upwardly on the compression stroke the air in chamber 51 is forced through the outlet openings 84 to open valve ring 98, thereby allowing the compressed air to flow through outlet passages 78 to the outer annular chamber 60 in head 38. The compressed air then flows through the outlet passage 62 into the after cooler indicated generally at 101 when an after cooler is utilized.

Valve assembly 61 is designed and constructed to operate efficiently at compressor rotational speeds of 2,000 rpm or more. The sleeves 74 and 76 of valve assembly 61 support head 38 in a clamped relationship with the top of cylinder 36B. The heat generated in the valve assembly 61 by the compressed air flowing through it is partially dissipated through head 38 to the outside air.

Figure 7:
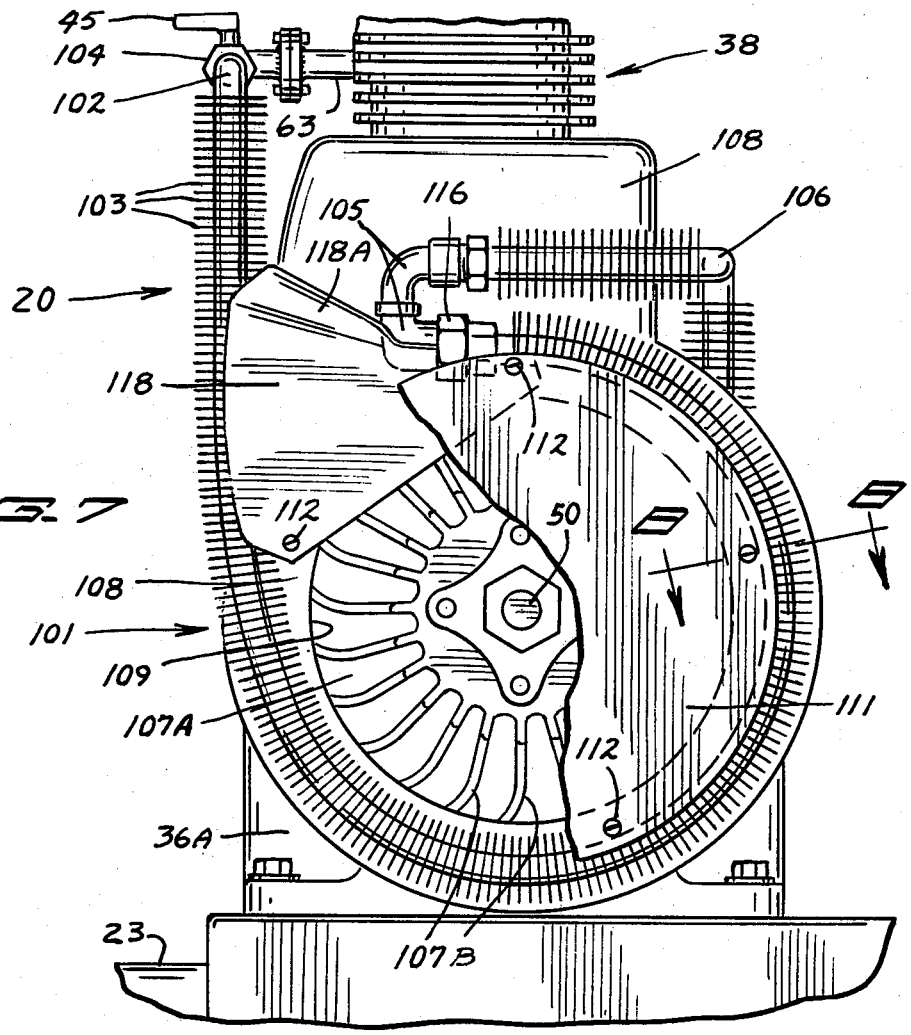
FIG. 7 is a rear elevational view of the gas compressor of FIG. 1 with the cooler cover plate broken away to show the blower rotor.
Figure 8:
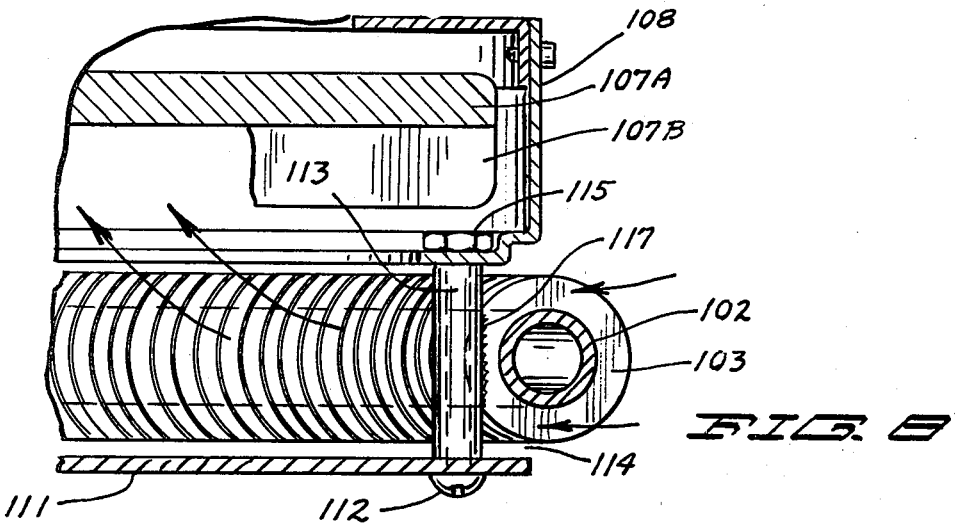
FIG. 8 is an enlarged sectional view taken along the line 8—8 of FIG. 7.

Referring to FIGS. 7 and 8, after cooler 101 comprises a cooling tube 102 carrying a plurality of side by side annular fins 103. Tube 102 has an inlet end 104 connected to the outlet flanged nipple to receive the hot compressed air from head 38. The opposite or outlet end 116 of tube 102 is connected with a pair of elbow couplings 105 to air outlet line 106. Couplings 105 can be replaced with a silver soldered or welded U-bend connector. Tube 106 can be provided with radial fins to further dissipate heat from the compressed air. A centrifugal blower comprises rotor 107A and an air shroud 108. Rotor 107A is connected to the end of crankshaft 47 and operates in a direct drive relationship with the power input shaft 47 of air compressor 20. Rotor 107A has a plurality of generally radial blades 107B which causes movement of air through the shroud 108. Rotor 107A, as shown in FIG. 8, is located within shroud 108 attached to compressor crankcase 36A. Shroud 108 has a central inlet opening 109. Shroud 108 and rotor 107A are part of the standard structure of the commercial air cooled I.C. engine.

A flat cover plate 111 is attached to shroud 108 with a plurality of screws 112 and spacer tubes 113. Screws 112 extend through spacer tubular members or spacer tubes and are threaded into nuts 115 secured to portions of shroud 108. Nuts 115 may be part of the commercial I.C. engine for mounting a recoil type starter. As shown in FIG. 8, cover plate 111 is spaced from shroud 108 by tubular members 113, thereby providing an annular air inlet opening or mouth 114. Cooling tube 102 is located in mouth 114. Adjacent fins 103 on tube 102 are secured by welds, silver solder, or the like at 117 to tubular members 113 to space fins 103 slightly away from housing 108 and cover 111 in order to avoid vibration damage. Tubular members 113 also serve to locate the circular portion of tube 102 in proper relationship to the cooling air intake of the commercial I.C. engine cooling structure.

A baffle 118 mounted by bolts 112 against the inside of circular plate 111 encloses the space between end couplings 105 and a part of the inlet section of tube 102. Baffle 118 has an upper lip 118A extended toward and engaging the shroud 108. Baffle 118 insures the flow of air past the inlet section of tube 102 as the air moves through the mouth 114 toward blower rotor 107A.

In use, referring to FIGS. 1, 7, and 8, motor 21 drives compressor 20 to deliver compressed air to tank 23. Valve assembly 61 functions to control the flow of air through head 38. The compressed air leaving head 38 being relatively hot is directed to after cooler 101. Some of the heat of the compressed air is transferred to the air surrounding the after cooler 101 as it flows through the after cooler. Rotor 107A draws air through annular mouth 114 thereby cooling tube 102. This cools the compressed air in tube 102. The compressed air cooling system is a suction type air-to-air after cooler.

Figure 10:
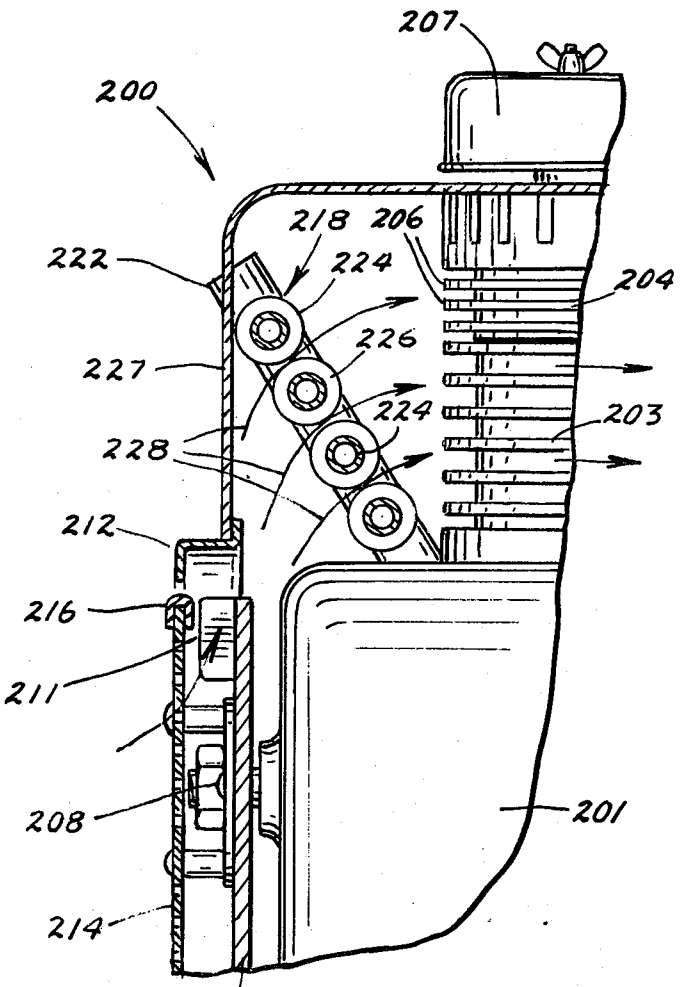
FIG. 10 is a sectional view taken along the line 10—10 of FIG. 9.
Figure 9:
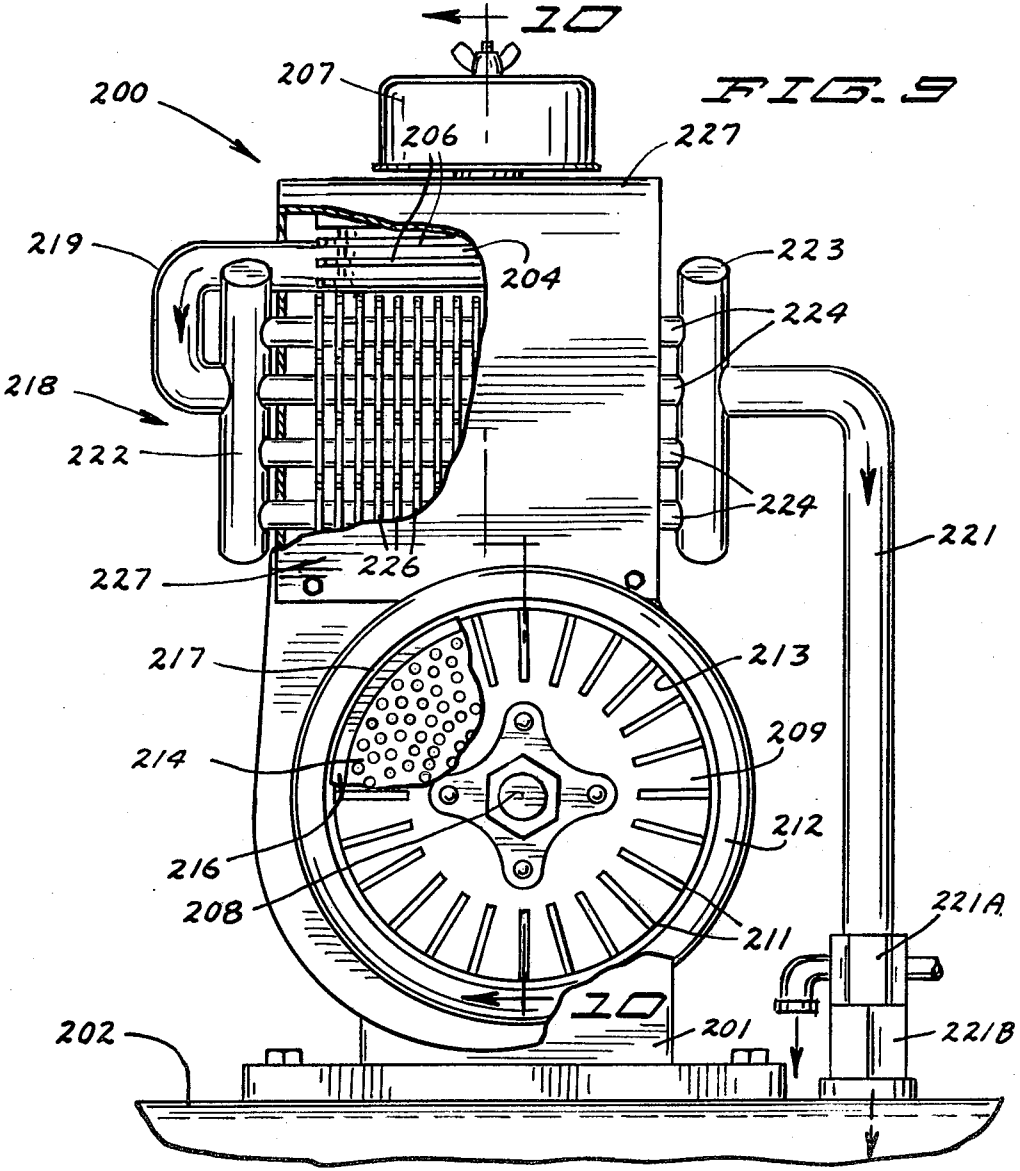
FIG. 9 is a rear elevational view of the gas compressor equipped with a modified after cooler.

Referring to FIGS. 9 and 10, there is shown a pneumatic fluid compressor indicated generally at 200 for compressing fluid, as air, and delivering compressed air to a receiver or tank (not shown). Compressor 200 is converted from a single cylinder, four-cycle air cooled I.C. engine. Compressor 200 has a crankcase 201 mounted on a base 202. Base 202 is supported on an air receiver, such as a tank (not shown). Head 204 is mounted on top of cylinder 203. Head 204 has a plurality of outwardly directed fins 206 to facilitate the dissipation of the heat of the air flowing through the head 204 and valve assembly located within the head. Head 204 has internal structure similar to head 38 shown in FIG. 3. A valve assembly which may be similar to valve assembly 61 located in the head 204 controls the flow of fluid to and from the pumping chamber of cylinder 203.

An air intake cleaner unit 207 is mounted on top of head 204. Unit 207 can be similar to unit 40 or the intake unit 328 hereinafter shown and described in FIGS. 11 and 12.

A rotatable crankshaft having an end 208 is mounted in crankcase 201. Rotor 209 of the I.C. engine cooling blower is secured to crankshaft end 208 for rotation thereby. Rotor 209 has a plurality of circumferentially spaced radial blades 211 that cause the pumping of cooling air through a housing or shroud 212. Shroud 212 surrounds the rotor 209 to collect the pumped cooling air and direct it to cylinder 203 and head 204. A protective perforated disc 214 secured to rotor 209 covers opening 213. As shown in FIG. 10, a ring 216 is secured to the outer peripheral edge of disc 214. The shroud 212, rotor 209, and disc 214 are all part of the standard air cooling system of a single cylinder four-cycle air cooled I.C. engine.

The compressed air from head 204 is delivered via a tubular member or pipe 219 to an after cooler indicated generally at 218. After cooler 218 is connected to an outlet pipe 221, which delivers the air to a manifold unloader valve 221A and a check valve 221B connected to a receiver (not shown). After cooler 218 has a generally upright inlet tubular manifold 222 and a corresponding generally upright outlet tubular manifold 223. A plurality of horizontal tubes 224 connected to manifolds 222 and 223 carry air from manifold 222 to manifold 223. A plurality of fins 226 are mounted on each of the tubes to facilitate the dissipation of heat from tubes 224. A cover or shield 227 secured to shroud 212 extends upwardly over tubes 224 and over the top of head 204. The top of the standard I.C. engine shroud has been cut off and replaced with cover 227. Cover 227 has a front wall and side walls forming a generally box-shaped structure open toward cylinder 203 and head 204. Cover 227 directs the air upwardly from rotor 209 through after cooler 218 and over cylinder 203 and head 204. The moving air, indicated by arrows 228, cools after cooler 218 and also cools cylinder 203 and head 204. Cover 227 is a special part that is substituted for the upper part of the standard I.C. engine shroud 212.

Figure 11:
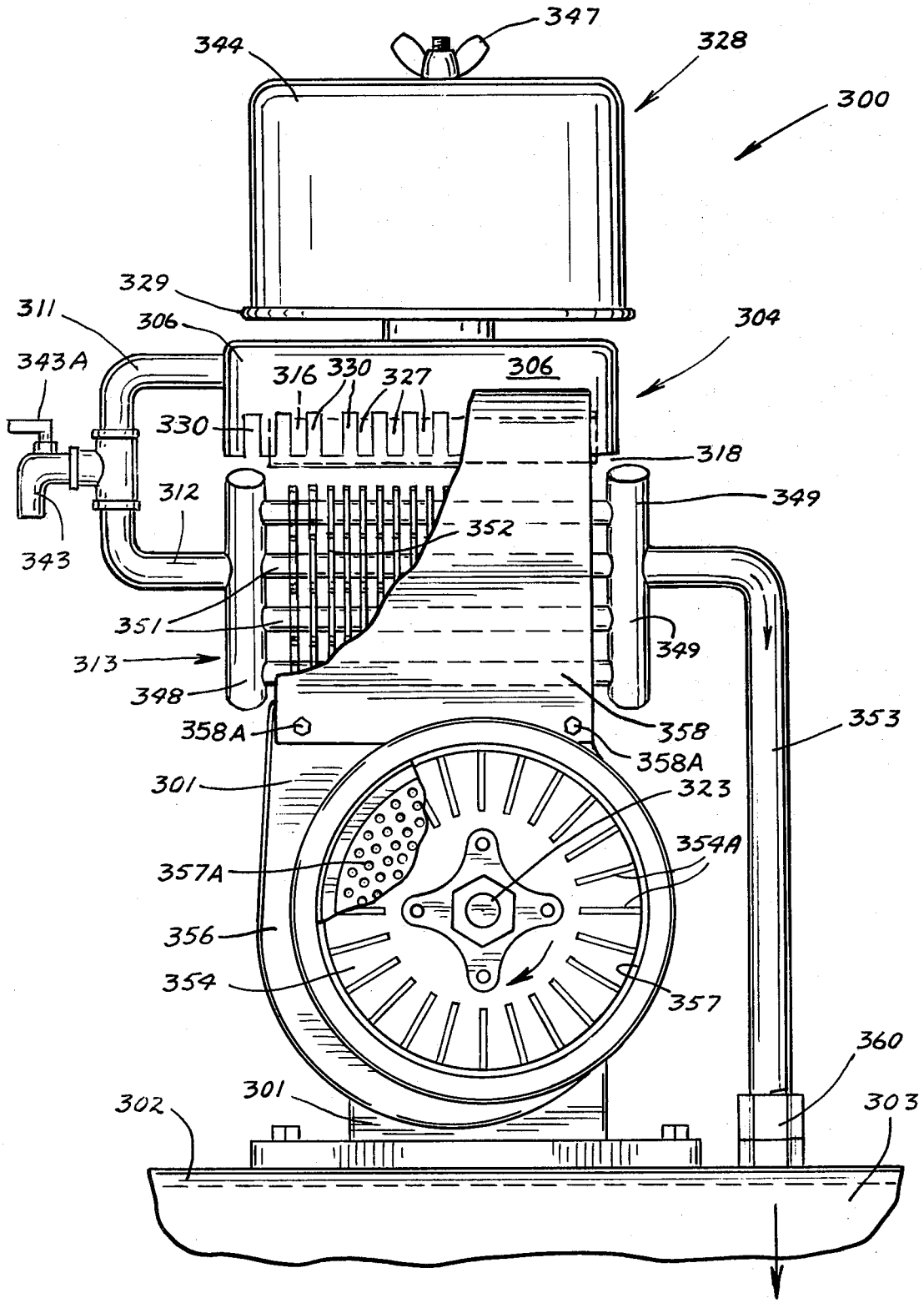
FIG. 11 is a rear elevational view of a second modification of the gas compressor of the invention with the shroud cover broken away to show the after cooler and head and the cooling air intake screen broken away to show the blower rotor.
Figure 12:
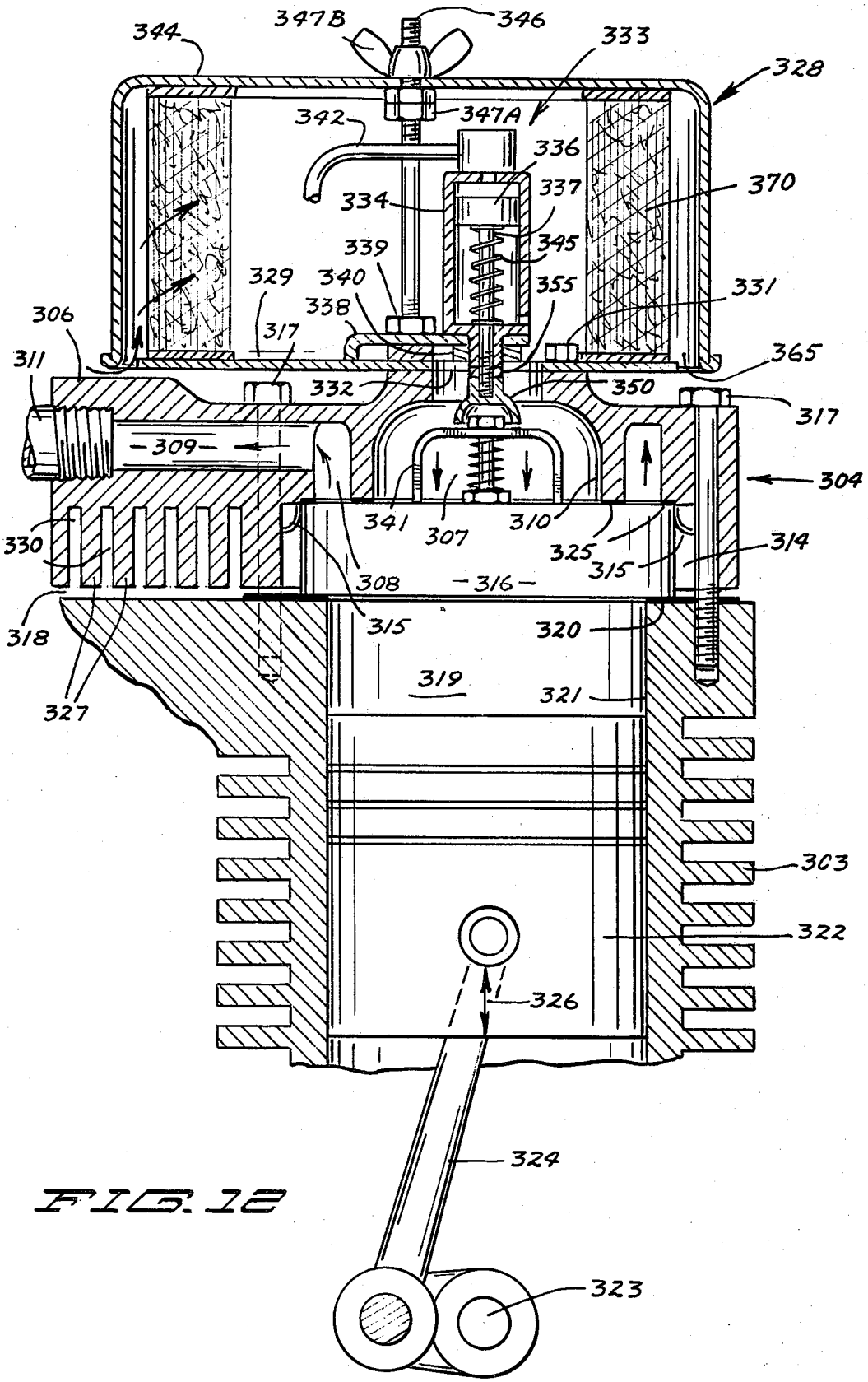
FIG. 12 is a vertical sectional view of the gas compressor of FIG. 11.

Referring to FIGS. 11 and 12, there is shown a further modification of the pneumatic fluid compressor of the invention indicated generally at 300. Compressor 300 is operable to compress pneumatic fluid, as air or other gases, and deliver the compressed fluid to a receiver or tank (not shown). Compressor 300 has a crankcase assembly 301 mounted on a base or support 302. A single cylinder 303 extends upwardly from crankcase assembly 301. Cylinder 303 can have a number of outwardly directed cooling fins similar to cylinder 36B shown in FIGS. 1 and 3. Crankcase assembly 301 and cylinder 303 are the block of a conventional air cooled single cylinder I.C. engine. A head indicated generally at 304 is mounted on top of cylinder 303. Head 304 has a relatively flat generally rectangular metal, as aluminum, head body 306 having a central air inlet chamber 307 and an annular outlet chamber 308. Chamber 308 surrounds inlet chamber 307 and is separated therefrom by an annular wall 310. A lateral outlet passage 309 connects annular chamber 308 and an outlet connection 311. A tubular line 312 joins connection 311 to an air-to-air after cooler indicated generally at 313. The after cooler may also be the coil type suction after cooler 101 shown in FIGS. 7 and 8. Thus, head 304 could be mounted on cylinder 36B. The standard shroud of the air cooling system of the I.C. engine can then be utilized without alteration to direct cooling air to the cylinder and head.

The bottom of head body 306 has a chamber or recess 314 accommodating a gas control valve assembly 316. Valve assembly 316 may have the same structure as valve assembly 61 shown in FIGS. 4, 5, and 6. A plurality of bolts 317 connect head body 306 to cylinder 303. Bolts 317 are threaded into the same tapped holes in cylinder 303 that are provided for the I.C. engine head bolts. The height to valve assembly 316 is greater than the depth of recess 314 so valve assembly 316 separates the bottom of body 306 and the top of the housing 311 by a space 318. Head body 306 has at least three short ears or bosses 315 that engage separate portions of valve assembly 316 to locate this assembly directly over the pumping chamber 319 formed by cylindrical wall 321.

As shown in FIG. 12, valve assembly 316 is a cylindrical valving unit that fits into recess 314 and has a diameter larger than the diameter of piston chamber 319. The bottom of valve assembly 316 engages a flat gasket 320 located on the top or deck of cylinder 303. Gasket 320 has suitable holes accommodating bolts 317. A second flat annular gasket 325 having two concentric rings is located on top of valve assembly 316. Gasket 325 engages annular wall 310 and also the portion of head body 306 located adjacent to the outer peripheral top of the outer sleeve of valve assembly 316. The bottom of head 304 is spaced a short distance 318 from the top or deck of cylinder 303. Space 318 insures that head 304 under pressure from bolts 317 applies a clamping force on opposite sides of valve assembly 316 locating gaskets 320 and 325 in clamped tight sealing engagement with valve assembly 316. This insures the sealing of valve assembly 316 with both cylinder 303 and head 304.

A reciprocating piston 322 of the commercial I.C. engine assembly reciprocates in chamber 319 to move the air into and out of chamber 319. Piston 322 is connected to a crankshaft 323 with a connecting rod 324. On rotation of crankshaft 323 piston 322 reciprocates as indicated by the arrows 326. The crankshaft 323, crankcase 301, cylinder 303, piston 322, and connecting rod 324 are all standard production I.C. engine components.

Head body 306 has a plurality of downwardly directed spaced cooling fins 327 which facilitate the dissipation of heat from head body 306, valve assembly 316, and hot air passage 309. The lower ends of fins 327 are spaced by a space 318 from the top of cylinder 303. Space 318 facilitates the clamping of valve assembly 316 between held 304 and cylinder 303. Fins 327 are laterally spaced from each other and extend transversely across the bottom of head body 306. Transverse grooves 330 located between adjacent fins 327 provide air passages for air from the cooling air blower to carry heat from head body 306 to the atmosphere. Grooves 330 have a depth about equal to the depth of recess 314. Air also flows in the annular recess 314 around valve assembly 316 and directly cools valve assembly 316 and the air moving through valve assembly 316. Pipes 311 and 312 and outlet pipe 353 can also be provided with a plurality of cooling fins (not shown) to enhance the dissipation of heat from these pipes.

As shown in FIGS. 11 and 12, an air intake cleaner unit indicated at 328 is mounted on top of head body 306. Cleaner unit 328 can be the cleaner unit that is furnished with a commercial I.C. engine. Cleaner unit 328 has a flat circular base plate 329 secured to the top of head body 306 with a plurality of bolts 331. The mid-section of plate 329 has an air inlet opening 332 aligned with inlet chamber 307 whereby air flows through cleaner unit 328 into head inlet chamber 307. Plate 329 has the usual mounting holes provided for the commercial air cleaner unit. Bolts 331 utilize these holes to mount air cleaner unit 328 on top of head body 306.

A valve release assembly or head unloader assembly indicated generally at 333 operates to hold the intake valving ring means of valve assembly 316 in an open position to automatically unload the compressor when a desired air pressure is attained in the tank or receiver. Valve release assembly 333 has an upright air cylinder 334 containing a reciprocating piston 336. A downwardly directed piston rod 337 is connected to piston 336. Cylinder 334 is mounted on a bracket 338 with a nut 340. Bracket 338 is attached to body 306 with a bolt and nut 339. A coil spring 345 concentrically positioned about piston rod 337 biases portion 336 in an upward direction. The lower end of piston rod 337 is threaded into an inverted cup-shaped member 350. A lock nut 355 fixes member 350 on piston rod 337. Cup-shaped member 350 bears against an inverted U-shaped three leg yoke 341. When piston 336 is in the up or release position, there is a slight clearance between the bottom of cup-shaped member 350 and yoke 341. When yoke 341 is pushed to its down position by member 350, the lower ends of yoke 341 engage the inlet valving ring means of valve assembly 316 and function to hold the inlet valving ring means in the open position so that the valve assembly 316 does not function on movement of piston 322 to deliver air under pressure to outlet chamber 208. The upper end of cylinder 334 is connected to an air line 342 leading to a pilot valve (not shown) in communication with the air under pressure in the tank or receiver. Line 342 extends through a suitable hole in plate 329 and downwardly to the pilot valve. The pilot valve is operable in response to selected air pressure levels to supply air under pressure to cylinder 334. For example, when the pressure in the tank reaches 125 psi, the pilot valve when set to operate at 125 psi is actuated whereby the air under pressure is applied to cylinder 334. The air pressure in cylinder 334 will move piston 336 in a downward direction so that yoke 341 will open the valving ring means and thereby terminate the pumping of air under pressure into the outlet chamber 308. A check valve 360, as shown in FIG. 11, prevents reverse flow of air under pressure from the tank back through after cooler 313 into head 304. When the air pressure in the tank drops below a preset value, for example, 115 psi, the pilot valve will release the air pressure in the air cylinder, so that spring 343 moves piston 336 to its upper position which in turn disengages cup member 350 from yoke 341, thereby allowing the pumping of air under pressure into outlet chamber 308.

A manually operated on-off valve 343 having a control lever 343A, as shown in FIG. 11, is teed off outlet line 312. When valve 343 is in the open position, the line 311 is in communication with the atmosphere. On-off valve 343 facilitates the starting of the engine because the piston 322 does not have to work against a head of air pressure when valve 343 is open to the atmosphere. As soon as the engine is operating, valve 343 is closed, whereby the air flows through the outlet tube 312 into the after cooler 313.

After cooler 313 has generally upright inlet and outlet tubular manifolds 348 and 349, respectively. A plurality of horizontal tubes 351 are connected at their opposite ends to manifolds 348 and 349. Each of tubes 351 has a plurality of fins or flanges 352 that facilitate the dissipation of heat from tubes 351. An outlet pipe 353 is connected to manifold 342 and tank (not shown) and delivers the air to check valve 360 which is in communication with the tank.

Returning to FIG. 12, an inverted cup-shaped housing or cover 344 is positioned over plate 329. An upright bolt 346 threaded into a hole in head body 306 projects through a hole in the center of the top of the cover 344. A pair of nuts 347A threaded onto bolt 346 function as a stop or support for cover 344. A wing nut 347B threaded onto the outer end of bolt 346 clamps cover 344 against the stop nuts 347A. Cover 344 has a diameter larger than the diameter of plate 329, thereby providing an annular air inlet mouth or space 365 for accommodating air moving into air cleaner unit 328. An annular air filter element 370 is interposed between the top of cover 344 and bottom plate 329. Filter element 370 is a conventional I.C. engine air filter that surrounds the head unloader assembly 333. Wing nut 347B can be removed from bolt 346 whereby cover 344 can be lifted from bolt 346 providing access to the unloader valve assembly 333 and permitting the cleaning or replacement of filter element 370.

As shown in FIG. 11, a blower rotor 354 is mounted on the outer end of the crankshaft 323. Rotor 354 has a plurality of vanes or blades 354A that pump air through shroud 356. An upwardly and inwardly curved air shroud cover 358 is secured to the upper part of shroud 356 with bolts 358A. The upper section of the conventional shroud of the I.C. engine is horizontally cut off and replaced with cover 358. Cover 358 directs the air through after cooler 313 and towards cylinder 303 and head 304. The upper edge of cover 358 is located in close linear relationship with one side of head 304 so that the air is directed to grooves 330 in the bottom of head body 306. Shroud 356 surrounds rotor 354 and has a central opening 357 to allow air to flow to rotor 354. A protective shield or screen 357A having holes is mounted on rotor 354 to cover opening 357. The air moved by rotor 354 is directed through the after cooler 313 and toward cylinder 303 and head 304 by upwardly curved cover or shield 358. The air moves through the spaces 330 between the adjacent fins 327 to directly cool head body 306 and directly cool valve assembly 316 and the compressed air therein.

The after cooler used with head 304 can be the suction type coil after cooler shown in FIGS. 7 and 8. This can be done by replacing head 38 with the head 304. The shroud 108 is located closely adjacent the linear side of head 304 so that the air moved by the blower cools the head, the cylinder, the valve assembly located between the head and cylinder, as well as the compressed air moving through the head and cylinder. The after cooler further cools the air as it moves through the finned tube surrounding the inlet blower mouth, as shown in FIG. 8.

Each gas compressor 20, 200, and 300 consists of a single cylinder, four cycle, air cooled, high production commercial I.C. engine converted for pumping gas, such as air, by substituting a suitable intake and outlet valve mechanism and cylinder head for the four cycle gasoline engine valve mechanism and cylinder head. An air-to-air after cooler for cooling the compressed hot air is used in conjunction with the engine air cooling system. By utilizing the commercial engine as the base structure, it is possible to run the gas compressor at a much higher rpm than normal for reciprocating piston type air compressors. For example, the compressors of the invention can be operated at 3600 rpm, which is a common running speed for a gasoline I.C. engine. The normal piston type air compressor operates at about 900 rpm. The gas compressors of the invention can run at high speeds without placing abnormal strain on the running components because they are of I.C. engine design and construction. This results in a gas output capability of approximately four times as great as from a conventional air compressor with the same piston displacement. The cost savings between the conventional reciprocating piston air compressor and the air compressor of the invention is of even larger magnitude, since single cylinder, air cooled, four cycle gasoline engines are produced in large quantities resulting in a relatively low cost per cylinder. Further, the air compressor of the invention requires only one such cylinder to provide an air output volume that is usually equaled only by four cylinders of a conventional piston type air compressor.

The standard air cooling system of the I.C. engine structure is designed to accommodate the high heat flux imposed by the combustion of a fuel mixture at a high rpm. This air cooling system is adequate to cool the compressor plus the air-to-air after cooler which reduces the air outlet temperature to the same range that is normal for conventional slow speed air compressors. For example, the compressed air coming from the head may have a temperature of about 475° to 500° F. with tank air pressure about 80 to 95 psi. The after cooler receiving the hot air reduces the temperature of the air or about 300° to 250° F. or less.

The air compressors are driven with a power source, such as an electric motor, an I.C. engine, air motors, hydraulic motors, and the like. When an I.C. engine is used, the engine can be of the same make and general type as used for the structure of the air compressor. Thus, a mechanic capable of servicing and repairing the standard, commercial I.C. engine can easily service and repair the air compressor. The principal running parts (except for the valve mechanism) of the standard commercial I.C. engine may also be interchangeable with those of the air compressor, thus reducing the required repair parts inventory. The advantages and economies of servicing and repairing the I.C. engine and similar air compressor combination under actual field operating conditions are of particular importance, constituting a distinct advantage especially under remote location operating conditions and in military operations.

While there has been shown and described the preferred embodiments of the gas compressor of the invention, it is understood that changes in the structures and sizes and materials may be made by those skilled in the art without departing from the invention. The compressor is described as compressing a gas, as air. Other types of gases can be compressed with the compressors 20, 200, and 300.

The embodiments of the invention in which an exclusive property or privilege is claimed are defined as follows:

1. A system for compressing and delivering partly cooled gas to a desired location, comprising: a tank for storing compressed gas, a platform secured to the tank, a conventional air cooled four-cycle single cylinder internal combustion engine mounted on the platform, a gas compressor mounted on the platform whereby the tank, platform, engine, and compressor form a unit-handled assembly, means drivably connecting said engine to said gas compressor whereby the engine drives the gas compressor, said compressor comprising engine components of an identical air cooled four-cycle single cylinder internal combustion engine including a crankcase assembly, a cylinder attached to the crankcase assembly, a piston, said cylinder having a bore accommodating said piston, crankshaft means connected to the piston, and blower means connected to the crankshaft means for moving aspirated air toward the cylinder, shroud means surrounding the blower means for directing air toward the cylinder, and compressor components including a valve assembly mounted on the upper end of said cylinder for controlling the flow of gas into and out of the bore in response to movement of the piston therein, head means located in superposed engagement with said valve assembly, said valve assembly spacing the head means from said cylinder to form an open space between the head means and said cylinder to minimize the transfer of heat from the head means to said cylinder, said head means having a gas inlet port and a compressed gas discharge port in cooperative relationship to said valve assembly for gas flow control, means to connect the head means to the cylinder and secure the valve assembly therebetween, an after cooler conduit connected to said head discharge port for carrying hot compressed gas from said head means to the tank, said conduit including an arcuate portion disposed in circumambient relation to said blower means in the inlet path of the aspirated air theretoward, and shield means connected to the shroud means centrally of said arcuate portion of the conduit in spaced relation to said shroud means and blower means for confining said aspirated inlet air flow substantially radially inwardly over and around said arcuate conduit portion toward said blower means.

2. The system of claim 1 wherein: said arcuate portion of the after cooler conduit is provided with a series of generally radially cooling fins, said fins being spaced from said blower means, shroud means, and said shield means.

3. The system of claim 1 including: a plurality of fins attached to the arcuate portion of the after cooler conduit, and spacer means connected to some of the fins to space the fins from the shroud means and shield means.

4. The system of claim 3 including: means attaching the shield means to the spacer means and the spacer means to the shroud means.

5. The system of claim 3 wherein: the shield means is a generally circular plate.

6. The system of claim 1 wherein: the drive means includes a belt and pulleys connecting the internal combustion engine with said compressor crankshaft means, said belt being located in driving engagement with said pulleys.

7. The system of claim 1 wherein: the head means has a plurality of spaced fins providing passages for accommodating air from the blower means to cool the head means, said air flowing through the open space between the head means and cylinder to cool the head means and cylinder.

8. A system for compressing and delivering partly cooled gas to a desired location, comprising: a tank for storing compressed gas, a platform secured to the tank, a conventional air cooled four-cycle single cylinder internal combustion engine mounted on the platform, a gas compressor mounted on the platform whereby the tank, platform, engine, and compressor form a unit-handled assembly, means drivably connecting said engine to said gas compressor whereby the engine drives the gas compressor, said compressor comprising engine components of an identical air cooled four-cycle single cylinder internal combustion engine including a crankcase assembly, a cylinder attached to the crankcase assembly, a piston, said cylinder having a bore accommodating said piston, crankshaft means connected to the piston, blower means connected to the crankshaft means for moving aspirated air toward the cylinder, shroud means surrounding the blower means for directing air toward the cylinder, and compressor components including a valve assembly mounted on the upper end of said cylinder for controlling the flow of gas into and out of the bore in response to movement of the piston therein, head means located in superposed engagement with said valve assembly, said valve assembly spacing the head means from the cylinder to form an open space between the head means and the cylinder to minimize the transfer of heat from the head means to the cylinder, said head means having a gas inlet port and a compressed gas discharge port in cooperative relationship to said valve assembly for gas flow control, means to connect the head means to the cylinder and secure the valve assembly therebetween, and after cooler means connected to said head discharge port for carrying hot compressed gas from said head means to the tank, said after cooler means having conduit means located in the path of the aspirated air whereby said air cools the gas in said conduit means.

9. The system of claim 8 wherein: drive means includes a belt and pulleys connecting the internal combustion engine with the compressor crankshaft means, said belt being located in driving engagement with said pulleys.

10. The system of claim 8 including: a plurality of fins attached to the conduit portions of said after cooler means.

11. The system of claim 10 including: spacer means connected to some of the fins to space the fins from the shroud means.

12. The system of claim 11 including: shield means connected to the spacer means, said sheild means being spaced from the fins.

13. The system of claim 8 wherein: the head means has a plurality of spaced fins providing passages for accommodating air from the blower means to cool the head means, said air flowing through the open space between the head means and cylinder to cool the head means and cylinder.

* * * * *

UNITED STATES PATENT AND TRADEMARK OFFICE

CERTIFICATE OF CORRECTION

PATENT NO. : 4,391,568

DATED : July 5, 1983

INVENTOR(S) : William L. Tenney

It is certified that error appears in the above-identified patent and that said Letters Patent is hereby corrected as shown below:

Column 1, line 49, "product on" should be -- production --.

Column 8, line 58, "held" should be -- head --.

Column 9, line 26, "portion" should be -- piston --.

Column 14, line 21, Claim 12, "sheild" should be -- shield --.

Signed and Sealed this

*Thirteenth* Day of *September 1983*

[SEAL]

*Attest:*

GERALD J. MOSSINGHOFF

*Attesting Officer*

*Commissioner of Patents and Trademarks*